US009672835B2

(12) United States Patent
Gao

(10) Patent No.: US 9,672,835 B2
(45) **Date of Patent: *Jun. 6, 2017**

(54) METHOD AND APPARATUS FOR CLASSIFYING AUDIO SIGNALS INTO FAST SIGNALS AND SLOW SIGNALS

(71) Applicant: HUAWEI TECHNOLOGIES CO., LTD., Shenzhen, Guangdong (CN)

(72) Inventor: Yang Gao, Mission Viejo, CA (US)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 76 days.

This patent is subject to a terminal disclaimer.

(21) Appl. No.: 14/687,689

(22) Filed: Apr. 15, 2015

(65) Prior Publication Data

US 2015/0221318 A1 Aug. 6, 2015

Related U.S. Application Data

(63) Continuation of application No. 12/554,861, filed on Sep. 4, 2009, now Pat. No. 9,037,474.

(60) Provisional application No. 61/094,880, filed on Sep. 6, 2008.

(51) Int. Cl.

| | |
|---|---|
| ***G10L 19/00*** | (2013.01) |
| ***G10L 19/025*** | (2013.01) |
| ***G10L 19/022*** | (2013.01) |
| ***G10L 19/22*** | (2013.01) |

(52) U.S. Cl.

CPC ..... *G10L 19/025* (2013.01); *G10L 19/022* (2013.01); *G10L 19/22* (2013.01)

(58) Field of Classification Search

CPC ..... G10L 19/22

See application file for complete search history.

(56) References Cited

U.S. PATENT DOCUMENTS

| | | | | |
|---|---|---|---|---|
| 5,455,888 | A | 10/1995 | Iyengar et al. | |
| 5,778,335 | A * | 7/1998 | Ubale | G10H 1/125 704/219 |
| 5,878,391 | A | 3/1999 | Aarts | |
| 6,134,518 | A | 10/2000 | Cohen et al. | |

(Continued)

OTHER PUBLICATIONS

Herre, "Robust Matching of Audio Signals Using Spectral Flatness Features", IEEE Workshop on Applications of Signal Processing to Audio and Acoustics 2001.*

(Continued)

*Primary Examiner* — Jialong He

(74) *Attorney, Agent, or Firm* — Huawei Technologies Co., Ltd.

(57) ABSTRACT

Low bit rate audio coding such as BWE algorithm often encounters conflict goal of achieving high time resolution and high frequency resolution at the same time. In order to achieve best possible quality, input signal can be first classified into fast signal and slow signal. This invention focuses on classifying signal into fast signal and slow signal, based on at least one of the following parameters or a combination of the following parameters: spectral sharpness, temporal sharpness, pitch correlation (pitch gain), and/or spectral envelope variation. This classification information can help to choose different BWE algorithms, different coding algorithms, and different post-processing algorithms respectively for fast signal and slow signal.

17 Claims, 7 Drawing Sheets

Example of basic principle of BWE decoder side

(56) References Cited

U.S. PATENT DOCUMENTS

| | | | | |
|---|---|---|---|---|
| 6,570,991 | B1 | 5/2003 | Scheirer et al. | |
| 6,633,841 | B1 | 10/2003 | Thyssen et al. | |
| 6,694,293 | B2 * | 2/2004 | Benyassine | G10L 19/18 704/219 |
| 6,785,645 | B2 * | 8/2004 | Khalil | G10L 19/22 704/216 |
| 7,120,576 | B2 * | 10/2006 | Gao | G10L 25/48 704/208 |
| 7,333,930 | B2 * | 2/2008 | Baumgarte | G10L 19/032 704/200.1 |
| 7,386,217 | B2 | 6/2008 | Zhang | |
| 7,598,447 | B2 | 10/2009 | Walker, II et al. | |
| 2002/0007280 | A1 | 1/2002 | McCree | |
| 2002/0138268 | A1 | 9/2002 | Gustafsson | |
| 2002/0161576 | A1 | 10/2002 | Benyassine et al. | |
| 2003/0050786 | A1 | 3/2003 | Jax et al. | |
| 2003/0093278 | A1 | 5/2003 | Malah | |
| 2003/0101050 | A1 | 5/2003 | Khalil et al. | |
| 2004/0002856 | A1 | 1/2004 | Bhaskar et al. | |
| 2004/0030544 | A1 | 2/2004 | Ramabadran | |
| 2005/0091066 | A1 * | 4/2005 | Singhal | G10L 25/78 704/500 |
| 2005/0096898 | A1 | 5/2005 | Singhal | |
| 2005/0108004 | A1 | 5/2005 | Otani et al. | |
| 2005/0177362 | A1 | 8/2005 | Toguri | |
| 2006/0015327 | A1 | 1/2006 | Gao | |
| 2006/0015333 | A1 * | 1/2006 | Gao | G10L 25/48 704/233 |
| 2006/0053007 | A1 * | 3/2006 | Niemisto | G10L 25/78 704/233 |
| 2007/0219787 | A1 * | 9/2007 | Manjunath | G10L 19/22 704/207 |
| 2008/0077412 | A1 * | 3/2008 | Oh | G10L 21/038 704/500 |
| 2008/0143518 | A1 * | 6/2008 | Aaron | H04M 1/72569 340/540 |
| 2008/0147414 | A1 | 6/2008 | Son et al. | |
| 2008/0162121 | A1 * | 7/2008 | Son | G10L 19/22 704/201 |
| 2009/0076814 | A1 | 3/2009 | Lee | |
| 2013/0346088 | A1 * | 12/2013 | Miao | G10L 19/00 704/500 |

OTHER PUBLICATIONS

Geoffroy Peeters, "Automatic classification of large musical instrument databases using hierarchical classifiers with inertia ratio maximization", AES 115th Convention, New York, NY, USA, Oct. 10-13, 2003.*

"Series G: Transmission Systems and Media, Digital Systems and Networks, Digital terminal equipments—Coding of analogue signals by methods other than PCM", ITU-T G.729, May 2006, total 8 pages.

"Series G: Transmission Systems and Media, Digital Systems and Networks, Digital terminal equipments—Coding of analogue signals by methods other than PCM", ITU-T G.729.1, Amendment 3, Aug. 2007, total 16 pages.

Michael J. Carey et al:"A comparison of features for speech, music discrimination", 1999, total 4 pages.

Ludovic Tancerel et al: "Combined speech and audio coding by discrimination", 2000, total 3 pages.

Omer Mohsin Mubarak et al: "Novel Features for Effective Speech and Music Discrimination", 2006, total 5 pages.

Martin F. McKinney et al: "Features for Audio and Music Classification", 2003, total 8 pages.

Lee et al: "Effective tonality detection algorithm based on spectrum engery in perceptual audio coder", 2004, total 1 pages.

* cited by examiner

Prior Art

FIG. 1 High-level block diagram of the G.729.1 encoder

Prior Art

FIG. 2 High-level block diagram of the TDBWE encoder for G.729.1

Prior Art

FIG. 3 High-level block diagram of the G.729.1 decoder

Prior Art

FIG. 4 High-level block diagram of the TDBWE decoder for G.729.1

Prior Art

FIG.5 G.729.1 – Pulse shape lookup table

FIG.6 Example of basic principle of BWE decoder side

METHOD AND APPARATUS FOR CLASSIFYING AUDIO SIGNALS INTO FAST SIGNALS AND SLOW SIGNALS

CROSS-REFERENCE TO RELATED APPLICATIONS

This application is a continuation of U.S. application Ser. No. 12/554,861 filed on Sep. 4, 2009, which claims priority to U.S. Provisional Application No. 61/094,880 filed on Sep. 6, 2008, entitled "Classification of Fast and Slow Signal," both of which are incorporated by reference in their entirety.

TECHNICAL FIELD

The present invention is generally in the field of speech/audio signal coding. In particular, the present invention is in the field of low bit rate speech/audio coding.

BACKGROUND

In modern audio/speech signal compression technologies, frequency domain coding has been widely used in various ITU-T, MPEG, and 3 GPP standards. If bit rate is high enough, spectral sub-bands are often coded with some kinds of vector quantization (VQ) approaches; if bit rate is very low, a concept of BandWidth Extension (BWE) is well possible to be used. The BWE concept sometimes is also called High Band Extension (HBE) or SubBand Replica (SBR). BWE usually comprises frequency envelope coding, temporal envelope coding (optional), and spectral fine structure generation. The corresponding signal in time domain of fine spectral structure is usually called excitation. For low bit rate encoding/decoding algorithms including BWE, the most critical problem is to encode fast changing signals, which sometimes require special or different algorithm to increase the efficiency.

The standard ITU-T G.729.1 includes typical CELP coding algorithm, typical transform coding algorithm, and typical BWE coding algorithm; the following summarized description of the related ITU-T G.729.1 will help in later description to understand why sometimes a classification of fast signal and slow signal is needed.

General Description of ITU G.729.1

ITU G.729.1 is also called G.729EV coder which is an 8-32 kbits scalable wideband (50-7000 Hz) extension of ITU-T Rec. G.729. By default, the encoder input and decoder output are sampled at 16 000 Hz. The bitstream produced by the encoder is scalable and consists of 12 embedded layers, which will be referred to as Layers 1 to 12. Layer 1 is the core layer corresponding to a bit rate of 8 kbits. This layer is compliant with G.729 bitstream, which makes G.729EV interoperable with G.729. Layer 2 is a narrowband enhancement layer adding 4 kbits, while Layers 3 to 12 are wideband enhancement layers adding 20 kbits with steps of 2 kbits.

This coder is designed to operate with a digital signal sampled at 16000 Hz followed by conversion to 16-bit linear PCM for the input to the encoder. However, the 8000 Hz input sampling frequency is also supported. Similarly, the format of the decoder output is 16-bit linear PCM with a sampling frequency of 8000 or 16000 Hz. Other input/output characteristics should be converted to 16-bit linear PCM with 8000 or 16000 Hz sampling before encoding, or from 16-bit linear PCM to the appropriate format after decoding. The bitstream from the encoder to the decoder is defined within this Recommendation.

The G.729EV coder is built upon a three-stage structure: embedded Code-Excited Linear-Prediction (CELP) coding, Time-Domain Bandwidth Extension (TDBWE) and predictive transform coding that will be referred to as Time-Domain Aliasing Cancellation (TDAC). The embedded CELP stage generates Layers 1 and 2 which yield a narrowband synthesis (50-4000 Hz) at 8 and 12 kbits. The TDBWE stage generates Layer 3 and allows producing a wideband output (50-7000 Hz) at 14 kbits. The TDAC stage operates in the Modified Discrete Cosine Transform (MDCT) domain and generates Layers 4 to 12 to improve quality from 14 to 32 kbits. TDAC coding represents jointly the weighted CELP coding error signal in the 50-4000 Hz band and the input signal in the 4000-7000 Hz band.

The G.729EV coder operates on 20 ms frames. However, the embedded CELP coding stage operates on 10 ms frames, like G.729. As a result two 10 ms CELP frames are processed per 20 ms frame. In the following, to be consistent with the text of ITU-T Rec. G.729, the 20 ms frames used by G.729EV will be referred to as superframes, whereas the 10 ms frames and the 5 ms subframes involved in the CELP processing will be respectively called frames and subframes. In this G.729EV, TDBWE algorithm is related to our topics.

G.729.1 Encoder

A functional diagram of the encoder part is presented in FIG. 1. The encoder operates on 20 ms input superframes. By default, the input signal 101, $s_{WB}(n)$, is sampled at 16000 Hz. Therefore, the input superframes are 320 samples long. The input signal $s_{WB}(n)$ is first split into two sub-bands using a QMF filter bank defined by the filters $H_1(z)$ and $H_2(z)$. The lower-band input signal 102, $s_{LB}^{qmf}(n)$, obtained after decimation is pre-processed by a high-pass filter $H_{h1}(z)$ with 50 Hz cut-off frequency. The resulting signal 103, $s_{LB}(n)$, is coded by the 8-12 kbits narrowband embedded CELP encoder. To be consistent with ITU-T Rec. G.729, the signal $s_{LB}(n)$ will also be denoted s(n). The difference 104, $d_{LB}(n)$, between s(n) and the local synthesis 105, $\hat{s}_{enh}(n)$, of the CELP encoder at 12 kbits is processed by the perceptual weighting filter $W_{LB}(z)$. The parameters of $W_{LB}$ (z) are derived from the quantized LP coefficients of the CELP encoder. Furthermore, the filter $W_{LB}$ (z) includes a gain compensation which guarantees the spectral continuity between the output 106, $d_{LB}^{w}(n)$, of $W_{LB}$ (z) and the higher-band input signal 107, $s_{HB}(n)$. The weighted difference $d_{LB}^{w}(n)$ is then transformed into frequency domain by MDCT. The higher-band input signal 108, $s_{HB}^{fold}(n)$, obtained after decimation and spectral folding by $(-1)^n$ is pre-processed by a low-pass filter $H_{h2}(z)$ with 3000 Hz cut-off frequency. The resulting signal $s_{HB}(n)$ is coded by the TDBWE encoder. The signal $s_{HB}(n)$ is also transformed into frequency domain by MDCT. The two sets of MDCT coefficients 109, $D_{LB}^{w}(k)$, and 110, $S_{HB}(k)$, are finally coded by the TDAC encoder. In addition, some parameters are transmitted by the frame erasure concealment (FEC) encoder in order to introduce parameter-level redundancy in the bitstream. This redundancy allows improving quality in the presence of erased superframes.

TDBWE Encoder

The TDBWE encoder is illustrated in FIG. 2. The TDBWE encoder extracts a fairly coarse parametric description from the pre-processed and down-sampled higher-band signal 201, $s_{HB}(n)$. This parametric description comprises time envelope 202 and frequency envelope 203 parameters. The 20 ms input speech superframe $s_{HB}(n)$ (8 kHz sampling frequency) is subdivided into 16 segments of length 1.25 ms each, i.e., each segment comprises 10 samples. The 16 time envelope parameters 102, $T_{env}(i)$, i=0, . . . , 15, are computed as logarithmic subframe energies before the quantization. For the computation of the 12 frequency envelope parameters 203, $F_{env}(j)$, j=0, . . . , 11, the signal 201, $s_{HB}(n)$, is windowed by a slightly asymmetric analysis window. This window is 128 tap long (16 ms) and is constructed from the rising slope of a 144-tap Hanning window, followed by the falling slope of a 112-tap Hanning window. The maximum of the window is centered on the second 10 ms frame of the current superframe. The window is constructed such that the frequency envelope computation has a lookahead of 16 samples (2 ms) and a lookback of 32 samples (4 ms). The windowed signal is transformed by FFT. The even bins of the full length 128-tap FFT are computed using a polyphase structure. Finally, the frequency envelope parameter set is calculated as logarithmic weighted sub-band energies for 12 evenly spaced and equally spaced and equally wide overlapping sub-bands in the FFT domain.

G.729.1 Decoder

A functional diagram of the decoder is presented in FIG. 3. The specific case of frame erasure concealment is not considered in this figure. The decoding depends on the actual number of received layers or equivalently on the received bit rate.

If the received bit rate is:

8 kbits (Layer 1): The core layer is decoded by the embedded CELP decoder to obtain 301, $\hat{s}_{LB}(n)=\hat{s}(n)$. Then $\hat{s}_{LB}(n)$ is postfiltered into 302, $\hat{s}_{LB}^{post}(n)$, and post-processed by a high-pass filter (HPF) into 303, $\hat{s}_{LB}^{qmf}(n)=\hat{s}_{LB}^{hpf}(n)$ The QMF synthesis filterbank defined by the filters $G_1(z)$ and $G_2(z)$ generates the output with a high-frequency synthesis 304, $\hat{s}_{HB}^{qmf}(n)$, set to zero.

12 kbits (Layers 1 and 2): The core layer and narrowband enhancement layer are decoded by the embedded CELP decoder to obtain 301, $\hat{s}_{LB}(n)=\hat{s}_{enh}(n)$, and $\hat{s}_{LB}(n)$ is then postfiltered into 302, $\hat{s}_{LB}^{post}(n)$ and high-pass filtered to obtain 303, $\hat{s}_{LB}^{qmf}(n)=\hat{s}_{LB}^{hpf}(n)$ The QMF synthesis filterbank generates the output with a high-frequency synthesis 304, $\hat{s}_{HB}^{qmf}(n)$ set to zero.

14 kbits (Layers 1 to 3): In addition to the narrowband CELP decoding and lower-band adaptive postfiltering, the TDBWE decoder produces a high-frequency synthesis 305, $\hat{s}_{HB}^{bwe}(n)$ which is then transformed into frequency domain by MDCT so as to zero the frequency band above 3000 Hz in the higher-band spectrum 306, $\hat{S}_{HB}^{bwe}(k)$. The resulting spectrum 307, $\hat{S}_{HB}(k)$ is transformed in time domain by inverse MDCT and overlap-add before spectral folding by $(-1)^n$. In the QMF synthesis filterbank the reconstructed higher band signal 304, $\hat{s}_{HB}^{qmf}(n)$ is combined with the respective lower band signal 302, $\hat{s}LB^{qmf}(n)=\hat{s}_{LB}^{post}(n)$ reconstructed at 12 kbits without high-pass filtering.

Above 14 kbits (Layers 1 to 4+): In addition to the narrowband CELP and TDBWE decoding, the TDAC decoder reconstructs MDCT coefficients 308, $\hat{D}_{LB}^{w}(k)$ and 307, $\hat{S}_{HB}(k)$, which correspond to the reconstructed weighted difference in lower band (0-4000 Hz) and the reconstructed signal in higher band (4000-7000 Hz). Note that in the higher band, the non-received sub-bands and the sub-bands with zero bit allocation in TDAC decoding are replaced by the level-adjusted sub-bands of $\hat{S}_{HB}^{bwe}(k)$. Both $\hat{D}_{LB}^{w}(k)$ and $\hat{S}_{HB}(k)$ are transformed into time domain by inverse MDCT and overlap-add. The lower-band signal 309, $\hat{d}_{LB}^{w}(n)$ is then processed by the inverse perceptual weighting filter $W_{LB}(z)^{-1}$. To attenuate transform coding artefacts, prepost-echoes are detected and reduced in both the lower- and higher-band signals 310, $\hat{d}_{LB}(n)$ and 311, $\hat{s}_{HB}(n)$. The lower-band synthesis $\hat{s}_{LB}(n)$ is postfiltered, while the higher-band synthesis 312, $\hat{s}_{HB}^{fold}(n)$, is spectrally folded by $(-1)^n$. The signals $\hat{s}_{LB}^{qmf}(n)=\hat{s}_{LB}^{post}(n)$ and $\hat{s}_{HB}^{qmf}(n)$ are then combined and upsampled in the QMF synthesis filterbank.

TDBWE Decoder

FIG. 4 illustrates the concept of the TDBWE decoder module. The TDBWE received parameters, which are computed by a parameter extraction procedure, are used to shape an artificially generated excitation signal 402, $\hat{s}_{HB}^{exc}(n)$, according to desired time and frequency envelopes 408, $\hat{T}_{env}(i)$, and 409, $\hat{F}_{env}(j)$. This is followed by a time-domain post-processing procedure.

The quantized parameter set consists of the value $\hat{M}_T$ and of the following vectors: $\hat{T}_{env,1}$, $\hat{T}_{env,2}$, $\hat{F}_{env,1}$, $\hat{F}_{env,2}$ and $\hat{F}_{env,3}$. The quantized mean time envelope $\hat{M}_T$ is used to reconstruct the time envelope and the frequency envelope parameters from the individual vector components, i.e.:

$$\hat{T}env(i)=\hat{T}_{env}^{M}(i)+\hat{M}_T,\ i=0, \ldots, 15 \tag{3}$$

and, $$\hat{F}env(j)=\hat{F}_{env}^{M}(j)+\hat{M}_T,\ j=0, \ldots, 11 \tag{4}$$

The decoded frequency envelope parameters $\hat{F}_{env}(j)$ with j=0, . . . , 11 are representative for the second 10 ms frame within the 20 ms superframe. The first 10 ms frame is covered by parameter interpolation between the current parameter set and the parameter set $\hat{F}_{env,old}(j)$ from the preceding superframe:

$$\hat{F}_{env,int}(j)=\frac{1}{2}\left(\hat{F}_{env,old}(j)+\hat{F}_{env}(j)\right),\ j=0, \ldots, 11 \tag{5}$$

The superframe of 403, $\hat{s}_{HB}^{T}(n)$, is analyzed twice per superframe. A filterbank equalizer is designed such that its individual channels match the sub-band division to realize the frequency envelope shaping with proper gain for each channel The TDBWE excitation signal 401, exc(n), is generated by 5 ms subframe based on parameters which are transmitted in Layers 1 and 2 of the bitstream. Specifically, the following parameters are used: the integer pitch lag $T_0$=int ($T_1$) or int($T_2$) depending on the subframe, the fractional pitch lag frac, the energy $E_c$ of the fixed codebook contributions, and the energy $E_p$ of the adaptive codebook contribution.

The parameters of the excitation generation are computed every 5 ms subframe. The excitation signal generation consists of the following steps:

estimation of two gains $g_v$ and $g_{uv}$ for the voiced and unvoiced contributions to the final excitation signal exc(n);

pitch lag post-processing;

generation of the voiced contribution;

generation of the unvoiced contribution; and low-pass filtering.

In G.729.1, TDBWE is used to code the wideband signal from 4 kHz to 7 kHz. The narrow band (NB) signal from 0 to 4 kHz is coded with G.729 CELP coder where the excitation consists of adaptive codebook contribution and fixed codebook contribution. The adaptive codebook contribution comes from the voiced speech periodicity; the fixed codebook contributes to unpredictable portion. The ratio of the energies of the adaptive and fixed codebook excitations (including enhancement codebook) is computed for each subframe:

$$\xi = \frac{E_p}{E_c} \tag{1}$$

In order to reduce this ratio ξ in case of unvoiced sounds, a "Wiener filter" characteristic is applied:

$$\xi_{post} = \xi \cdot \frac{\xi}{1+\xi} \tag{2}$$

This leads to more consistent unvoiced sounds. The gains for the voiced and unvoiced contributions of exc(n) are determined using the following procedure. An intermediate voiced gain $g'_v$ is calculated by:

$$g'_v = \sqrt{\frac{\xi_{post}}{1+\xi_{post}}} \tag{3}$$

which is slightly smoothed to obtain the final voiced gain $g_v$:

$$g_v = \sqrt{\frac{1}{2}(g'^2_v + g'^2_{v,old})} \tag{4}$$

where $g'_{v,old}$ is the value of $g'_v$ of the preceding subframe.

To satisfy the constraint $g_v^2+g_{uv}^2=1$, the unvoiced gain is given by:

$$g_{uv}=\sqrt{1-g_v^2} \tag{5}$$

The generation of a consistent pitch structure within the excitation signal exc(n) requires a good estimate of the fundamental pitch lag $t_0$ of the speech production process. Within Layer 1 of the bitstream, the integer and fractional pitch lag values $T_0$ and frac are available for the four 5 ms subframes of the current superframe. For each subframe the estimation of $t_0$ is based on these parameters.

The aim of the G.729 encoder-side pitch search procedure is to find the pitch lag which minimizes the power of the LTP residual signal. That is, the LTP pitch lag is not necessarily identical with $t_0$, which is a requirement for the concise reproduction of voiced speech components. The most typical deviations are pitch-doubling and pitch-halving errors, i.e., the frequency corresponding to the LTP lag is the half or double that of the original fundamental speech frequency. Especially, pitch-doubling (-tripling, etc.) errors have to be strictly avoided. Thus, the following post-processing of the LTP lag information is used. First, the LTP pitch lag for an oversampled time-scale is reconstructed from $T_0$ and frac, and a bandwidth expansion factor of 2 is considered:

$$t_{LTP}=2\cdot(3\cdot T_0+frac) \tag{6}$$

The (integer) factor between the currently observed LTP lag $t_{LTP}$ and the post-processed pitch lag of the preceding subframe $t_{post,old}$ is calculated. The pitch lag is corrected, producing a continuous pitch lag $t_{post}$ w.r.t. the previous pitch lags, which is further smoothed as:

$$t_p = \frac{1}{2}\cdot(t_{post,old} + t_{post}) \tag{7}$$

Note that this moving average leads to a virtual precision enhancement from a resolution of ⅓ to ⅙ of a sample. Finally, the post-processed pitch lag $t_p$ is decomposed in integer and fractional parts:

$$t_{0,int} = \mathrm{int}\left(\frac{t_p}{6}\right) \text{ and } t_{0,frac} = t_p - 6\cdot t_{0,int}.$$

The voiced components 406, $s_{exc,v}(n)$, of the TDBWE excitation signal are represented as shaped and weighted glottal pulses. Thus $s_{exc,v}(n)$ is produced by overlap-add of single pulse contributions:

$$S_{exc,v}(n) = \sum_p g_{Pulse}^{[p]} \times P_{n_{Pulse,frac}^{[p]}}\left(n - n_{Pulse,int}^{[p]}\right) \tag{8}$$

where $n_{Pulse,int}^{[p]}$ is a pulse position, $P_{n_{Pulse,frac}^{[p]}}(n-n_{pulse,int}^{[p]})$ is the pulse shape, and $g_{Pulse}^{[p]}$ is a gain factor for each pulse. These parameters are derived in the following. The post-processed pitch lag parameters $t_{0,int}$ and $t_{0,frac}$ determine the pulse spacing and thus the pulse positions: $n_{Pulse,int}^{[p]}$ is the (integer) position of the current pulse and $n_{Pulse,int}^{[p-1]}$ is the (integer) position of the previous pulse, where p is the pulse counter. The fractional part of the pulse position serves as an index for the pulse shape selection. The prototype pulse shapes $P_i(n)$ with i=0, . . . , 5 and n=0, . . . , 56 are taken from a lookup table which is plotted in FIG. 5. These pulse shapes are designed such that a certain spectral shaping, i.e., a smooth increase of the attenuation of the voiced excitation components towards higher frequencies, is incorporated and the full sub-sample resolution of the pitch lag information is utilized. Further, the crest factor of the excitation signal is strongly reduced and an improved subjective quality is obtained.

The gain factor $g_{Pulse}^{[p]}$ for the individual pulses is derived from the voiced gain parameter $g_v$ and from the pitch lag parameters. Here, it is ensured that increasing pulse spacing does not decrease the contained energy. The function even( ) returns 1 if the argument is an even integer number and 0 otherwise.

The unvoiced contribution 407, $s_{exc,uv}(n)$, is produced using the scaled output of a white noise generator:

$$s_{exc,uv}(n)=g_{uv}\cdot\mathrm{random}(n),\ n=0, \ldots, 39 \tag{9}$$

Having the voiced and unvoiced contributions $s_{exe,v}(n)$ and $s_{exe,uv}(n)$, the final excitation signal 402, $\hat{s}_{HB}^{exc}(n)$, is obtained by low-pass filtering of $exc(n)=s_{exe,v}(n)+s_{exe,uv}(n)$.

The low-pass filter has a cut-off frequency of 3000 Hz and its implementation is identical with the pre-processing low-pass filter for the high band signal.

Post-Processing of the Decoded Higher Band

For the high-band, the frequency domain (TDAC) post-processing is performed on the available MDCT coefficients at the decoder side. There are 160 higher-band MDCT coefficients which are noted as $\hat{Y}(k)$, k=160, . . . , 319. For this specific post-processing, the higher band is divided into 10 sub-bands of 16 MDCT coefficients. The average magnitude in each sub-band is defined as the envelope:

$$env(j) = \sum_{k=0}^{15} \left|\hat{Y}(160+15j+k)\right|, \quad j = 0, 1, \ldots, 9 \tag{10}$$

The post-processing consists of two steps. The first step is an envelope post-processing (corresponding to short-term post-processing) which modifies the envelope; the second step is a fine structure post-processing (corresponding to long-term post-processing) which enhances the magnitude of each coefficient within each sub-band. The basic concept is to make the lower magnitudes relatively further lower, where the coding error is relatively bigger than the higher magnitudes. The algorithm to modify the envelope is described as follows. The maximum envelope value is:

$$env_{max} = \max_{j=0,\ldots,9} env(j) \tag{11}$$

Gain factors, which will be applied to the envelope, are calculated with the equation:

$$fac_1(j) = \alpha_{ENV}\frac{env(j)}{env_{max}} + (1-\alpha_{ENV}), \quad j = 0, \ldots, 9 \tag{12}$$

where $\alpha_{ENV}$ ($0<\alpha_{ENV}<1$) depends on the bit rate. The higher the bit rate, the smaller the constant $\alpha_{ENV}$. After determining the factors $fac_1(j)$, the modified envelope is expressed as:

$$env'(j)=g_{norm}fac_1(j)env(j),\ j=0,\ldots,9 \tag{13}$$

where $g_{norm}$ is a gain to maintain the overall energy. The fine structure modification within each sub-band will be similar to the above envelope post-processing. Gain factors for the magnitudes are calculated as:

$$fac_2(j,k) = \beta_{ENV}\frac{|\hat{Y}(160+16j+k)|}{Y_{max}(j)} + (1-\beta_{ENV}), \quad k = 0, \ldots, 15 \tag{14}$$

where the maximum magnitude $Y_{max}(j)$ within a sub-band is:

$$Y_{max}(j) = \max_{k=0,\ldots,15} |\hat{Y}(160+16j+k)| \tag{15}$$

and $\beta_{ENV}$ ($0<\beta_{ENV}<1$) depends on the bit rate. The higher the bit rate, the smaller $\beta_{ENV}$. By combining both the envelope post-processing and the fine structure post-processing, the final post-processed higher-band MDCT coefficients are:

$$\hat{Y}_{post}(160+16j+k)=g_{norm}fac_1(j)fac_2(j,k)\hat{Y}(160+16j+k),\quad j=0,\ldots,9\ k=0,\ldots,15 \tag{16}$$

SUMMARY

Low bit rate audio/speech coding such as BWE algorithm often encounters conflict goal of achieving high time resolution and high frequency resolution. In order to achieve best possible quality, input signal can be classified into fast signal and slow signal. High time resolution is more critical for fast signal while high frequency resolution is more important for slow signal. This invention focuses on classifying signal into fast signal and slow signal, based on at least one of the following parameters or a combination of the following parameters: spectral sharpness, temporal sharpness, pitch correlation (pitch gain), and/or spectral envelope variation. This classification information can help generation of fine spectral structure when BWE algorithm is used; it can be employed to design different coding algorithms respectively for fast signal and slow signal; it can also be used to control different post-processing respectively for fast signal and slow signal.

In one embodiment, a method of classifying audio signal into fast signal and slow signal is based on at least one of the following parameters or a combination of the following parameters: spectral sharpness, temporal sharpness, pitch correlation (pitch gain), and/or spectral envelope variation. Fast signal shows its fast changing spectrum or fast changing energy; slow signal indicates both spectrum and energy of the signal change slowly. Speech signal and energy attack music signal can be classified as fast signal while most music signals are classified as slow signal.

In another embodiment, high band fast signal can be coded with BWE algorithm producing high time resolution, such as keeping temporal envelope coding and the synchronization with low band signal; high band slow signal can be coded with BWE algorithm producing high frequency resolution, for example, which does not keep temporal envelope coding and the synchronization with low band signal.

In another embodiment, fast signal can be coded with time domain coding algorithm producing high time resolution, such as CELP coding algorithm; slow signal can be coded with frequency domain coding algorithm producing high frequency resolution, such as MDCT based coding.

In another embodiment, fast signal can be post-processed with time domain post-processing approach, such as CELP post-processing approach; slow signal can be post-processed with frequency domain post-processing approach, such as MDCT based post-processing approach.

BRIEF DESCRIPTION OF DRAWINGS

The features and advantages of the present invention will become more readily apparent to those ordinarily skilled in the art after reviewing the following detailed description and accompanying drawings, wherein.

DESCRIPTION OF EMBODIMENTS

Figure 1:
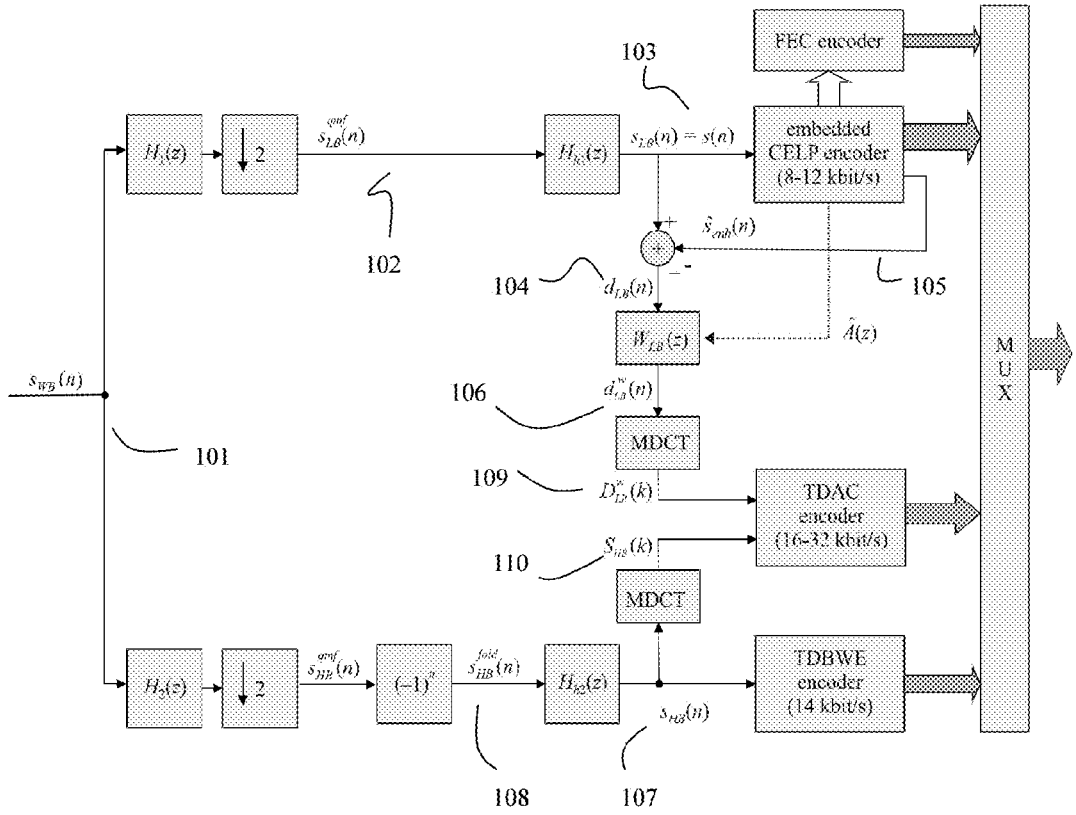
FIG. 1 gives high-level block diagram of the ITU-T G.729.1 encoder.
Figure 2:
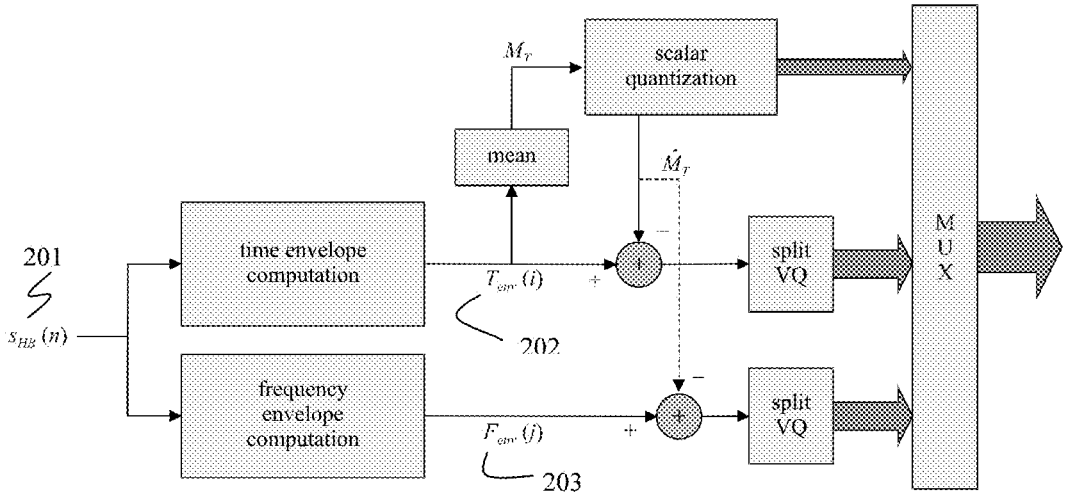
FIG. 2 gives high-level block diagram of the TDBWE encoder for G.729.1.

The making and using of the embodiments of the disclosure are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Frequency domain coding has been widely used in various ITU-T, MPEG, and 3 GPP standards. If bit rate is high enough, spectral sub-bands are often coded with some kinds of vector quantization (VQ) approaches; if bit rate is very low, a concept of BandWidth Extension (BWE) is well possible to be used. The BWE concept sometimes is also called High Band Extension (HBE) or SubBand Replica (SBR). Although the name could be different, they all have the similar meaning of encoding/decoding some frequency sub-bands (usually high bands) with little budget of bit rate or significantly lower bit rate than normal encoding/decoding approach. BWE often encodes and decodes some perceptually critical information within bit budget while generating some information with very limited bit budget or without spending any number of bits; BWE usually comprises frequency envelope coding, temporal envelope coding (optional), and spectral fine structure generation. The precise description of spectral fine structure needs a lot of bits, which becomes not realistic for any BWE algorithm. A realistic way is to artificially generate spectral fine structure, which means that the spectral fine structure could be copied from other bands or mathematically generated according to limited available parameters. The corresponding signal in time domain of fine spectral structure is usually called excitation. For any kind of low bit rate encoding/decoding algorithms including BWE, the most critical problem is to encode fast changing signals, which sometimes require special or different algorithm to increase the efficiency.

Low bit rate audio/speech coding such as BWE algorithm often encounters conflict goal of achieving high time resolution and high frequency resolution; when high time resolution is achieved, high frequency resolution may not be achieved; when high frequency resolution is achieved, high time resolution may not be achieved. In order to achieve best possible quality, input signal can be classified into fast signal and slow signal; fast signal shows fast changing spectrum or fast changing energy; slow signal means both spectrum and energy are changing slowly; most speech signals are classified as fast signal; most music signals are claimed as slow signal except for some special signals such as castanet signals which should be in the category of fast signal. High time resolution is more critical for fast signal while high frequency resolution is more important for slow signal. This invention focuses on classifying signal into fast signal and slow signal, based on at least one of the following parameters or a combination of the following parameters: spectral sharpness, temporal sharpness, pitch correlation (pitch gain), and/or spectral envelope variation. This classification information can help generation of fine spectral structure when BWE algorithm is used; it can be employed to design different coding algorithms respectively for fast signal and slow signal; for example, temporal envelope coding is applied or not; it can also be used to control different post-processings respectively for fast signal and slow signal. If high bands are coded with BWE algorithm and fine spectral structure of the high bands is generated, perceptually it is more important for fast signal to keep the synchronization between the high band signal and the low band signal; however, for slow signal, it is more important to have stable and less noisy spectrum.

In this description, ITU-T G.729.1 will be used as an example of the core layer for a scalable super-wideband codec. Frequency domain can be defined as FFT transformed domain; it can also be in MDCT (Modified Discrete Cosine Transform) domain. A well known pre-art of BWE can be found in the standard ITU G.729.1 in which the algorithm is named as TDBWE (Time Domain Bandwidth Extension).

The above BWE example employed in G.729.1 works at the sampling rate of 16000 Hz. The following proposed approach will not be limited at the sampling rate of 16000 Hz; it could also work at the sampling rate of 32000 Hz or any other sampling rate. For the simplicity, the following simplified notations generally mean the same concept for any sampling rate.

As already mentioned, BWE algorithm usually consists of spectral envelope coding, temporal envelope coding (optional), and spectral fine structure generation (excitation generation). This invention can be related to spectral fine structure generation (excitation generation); in particular, the invention is related to select different generated excitations (or different generated fine spectral structures) based on the classification of fast signal and slow signal. The classification information can be also used to select totally different coding algorithms respectively for fast signal and slow signal. This description will focus on the classification of fast signal and slow signal.

The TDBWE in G.729.1 aims to construct the fine spectral structure of the extended sub-bands from 4 kHz to 7 kHz. The concept described here will be more general; it is not limited to specific extended sub-bands; however, as examples to explain the invention, the extended sub-bands can be defined from 8 kHz to 14 k Hz, assuming that the low bands from 0 to 8 k Hz are already encoded and transmitted to decoder; in these examples, the sampling rate of the original input signal is 32 k Hz. The signal at the sampling rate of 32 kHz covering [0, 16 kHz] bandwidth is called super-wideband (SWB) signal; the down-sampled signal covering [0, 8 kHz] bandwidth is called wideband (WB) signal; the further down-sampled signal covering [0, 4 kHz] bandwidth is called narrowband (NB) signal. The examples explain how to construct the extended sub-bands covering [8 kHz, 14 kHz] by using available NB and WB signals (or NB and WB spectrum). The similar or same ways can be also employed to extend [0, 4 kHz] NB spectrum to the WB area of [4 k,8 kHz] if NB is available while [4 k,8 kHz] is not available at decoder side.

In ITU-T G.729.1, the harmonic portion 406, $s_{exc,v}(n)$, is artificially or mathematically generated according to the parameters (pitch and pitch gain) from the CELP coder which encodes the NB signal. This model of TDBWE assumes the input signal is human voice so that a series of shaped pulses are used to generate the harmonic portion. This model could fail for music signal mainly due to the following reasons. For music signal, the harmonic structure could be irregular, which means that the harmonics could be unequally spaced in spectrum while TDBWE assumes regular harmonics which are equally spaced in the spectrum. The irregular harmonics could result in wrong pitch lag estimation. Even if the music harmonics are equally spaced in spectrum, the pitch lag (corresponding the distance of two adjacent harmonics) could be out of range defined for speech signal in G.729.1 CELP algorithm. Another case for music signal, which occasionally happens, is that the narrowband (0-4 kHz) is not harmonic while the high band is harmonic; in this case the information extracted from the narrowband can't be used to generate the high band fine spectral structure.

Suppose the generated fine spectral structure is defined as a combination of harmonic-like component and noise-like component:

$$S_{BWE}(k)=g_h \cdot S_h(k)+g_n \cdot S_n(k) \tag{17}$$

Figure 6:
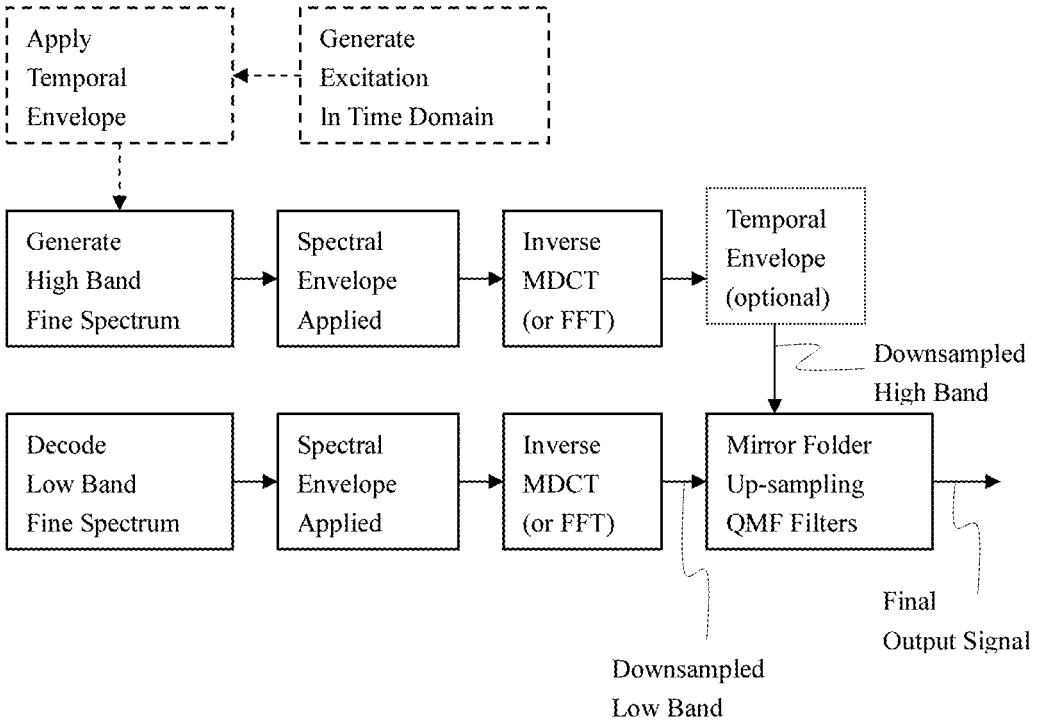
FIG. 6 shows an example of basic principle of BWE decoder side.

In (17), Sh(k) contains harmonics, Sn(k) is random noise; gh and gn are the gains to control the ratio between the harmonic-like component and noise-like component; these two gains could be subband dependent. When gn is zero, SBWE(k)=Sh(k). How to determine the gains will not be discussed in this description. Actually, the selective and adaptive generation of the harmonic-like component of Sh(k) is the important portion to have successful construction of the extended fine spectral structure, because the random noise is easy to be generated. If the generated excitation is expressed in time domain, it could be, $$s_{BWE}(n)=g_h \cdot s_h(n)+g_n \cdot s_n(n), \tag{18}$$

sh(n) contains harmonics. FIG. 6 shows the general principle of the BWE. The temporal envelope coding block in FIG. 6 is dashed because it can be also applied before the BWE spectrum SWBE(k) is generated; in other words, (18) can be generated first; then the temporal envelope shaping is applied in time domain; the temporally shaped signal is further transformed into frequency domain to get SWBE(k) for applying the spectral envelope. If SWBE(k) is directly generated in frequency domain, the temporal envelope shaping must be applied afterword.

As examples, assume WB (0-8 kHz) is available at decoder and the SWB (8 k-14 kHz) needs to be extended from WB (0-8 kHz). One of the solutions could be the time domain construction of the extended excitation as described in G.729.1; however, this solution has potential problems for music signals as already explained above.

Another possible solution is to simply copy the spectrum of 0-6 kHz to 8 k-14 kHz area; unfortunately, relying on this solution could also result in problems as explained later. In case that the G.729.1 is in the core layer of WB (0-8 kHz) portion, the NB is mainly coded with the time domain CELP coder and there is no complete spectrum of WB (0-6 kHz) available at decoder side so that the complete spectrum of WB (0-8 kHz) needs to be transformed from the decoded time domain WB output signal; this transformation is necessary because the proper spectral envelope should be applied and probably sub-band dependent gain control (also called spectral sharpness control) should also be performed. Consequently, this transformation itself causes time delay (typically 20 ms) due to the overlap-add required by the MDCT transformation. A delayed signal in high band compared to low band signal could influence severely the perceptual quality if the input original signal is a fast changing signal such as castanet music signal, or some fast changing speech signal. On the other hand, when the input signal is slowly changing, the 20 ms delay may not be a problem while a better fine spectrum definition is more important.

Figure 3:
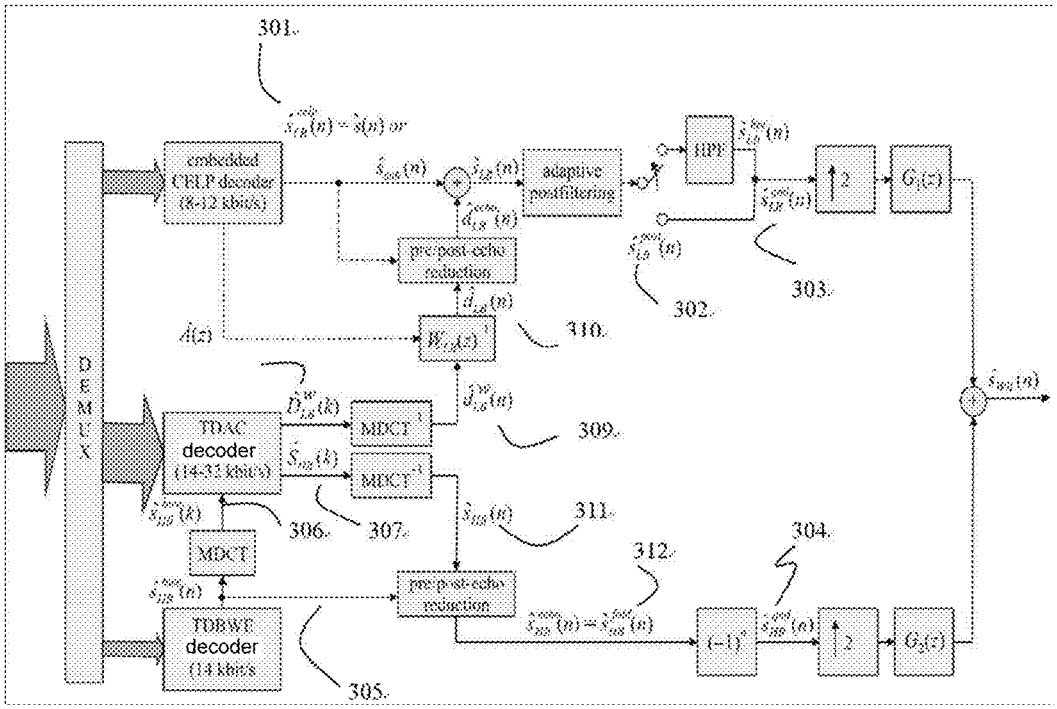
FIG. 3 gives high-level block diagram of the G.729.1 decoder.
Figure 4:
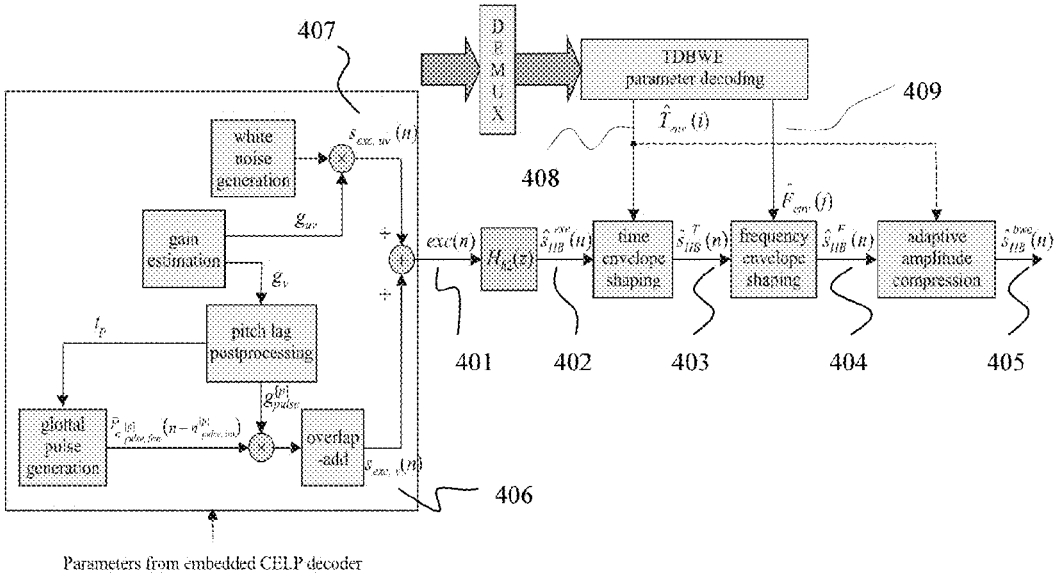
FIG. 4 gives high-level block diagram of the TDBWE decoder for G.729.1.
Figure 5:
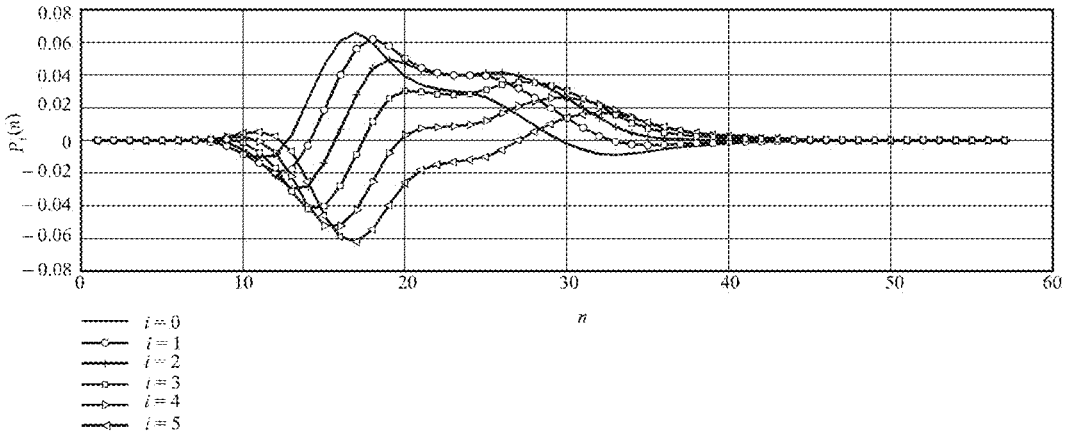
FIG. 5 gives pulse shape lookup table for the TDBWE of G.729.1.

In order to achieve the best quality for different possible situations, a selective and/or adaptive way to generate the high band harmonic component Sh(k) or sh(n) may be the best choice. For example, when the input signal is fast changing such as most of speech signal or castanet music signal, the synchronization between the low bands and the extended high bands is the highest priority and the time resolution is more important than the frequency resolution; in this case, the CELP output (NB signal) (see FIG. 3) without the MDCT enhancement layer in NB, $\hat{s}_{LB}^{celp}(n)$, can be used to construct the extended high bands; although the inverse MDCT in FIG. 6 causes 20 ms delay, the CELP output is advanced 20 ms so that the final output signal of the extended high bands is synchronized with the final output signal of the low bands in time domain. For another example, when the input signal is slowly changing such as most classical music signals, the WB output $\hat{s}_{WB}(n)$ including all MDCT enhancement layers from the G.729.1 decoder should be employed to generate the extended high bands, although some delay may be introduced. As already mentioned, the classification information can be also used to design totally different algorithms respectively for slow signal and fast signal. As a conclusion from perceptual point of view, the time domain synchronization is more critical for fast signal while the frequency domain quality is more important for slow signal; the time resolution is more critical for fast signal while the frequency resolution is more important for slow signal.

The proposed classification of fast signal and slow signal consists of one of the following parameters or a combination of the following parameters:

Spectral sharpness; this parameter is measured on spectral sub-bands; one spectral sharpness parameter is defined as a ratio between largest coefficient and average coefficient magnitude in one of sub-bands. Spectral sharpness is mainly measured on the spectral sub-bands of the high band area with the spectral envelope removed; it is defined as a ratio between the largest coefficient and the average coefficient magnitude in one of the sub-bands, $$P_1 = \frac{\mathrm{Max}\{|MDCT_i(k)|,\ k = 0, 1, 2, \ldots N_i - 1\}}{\frac{1}{N_i} \cdot \sum_k |MDCT_i(k)|}, \tag{19}$$

MDCTi(k) is MDCT coefficients in the i-th frequency subband with the spectral envelope removed; Ni is the number of MDCT coefficients of the i-th subband; P1 usually corresponds to the sharpest (largest) ratio among the sub-bands; P1 can also be expressed as average sharpness in the high bands. For speech signal or energy attack signal, normally the spectrum in high bands is less sharp.

Temporal sharpness; this parameter is measured on temporal envelope, and defined as a ratio of peak magnitude to average magnitude on one time domain segment. One example of temporal sharpness can be expressed as, $$P_2 = \frac{\mathrm{Max}\{T_{env}(i),\ i = 0, 1, \ldots\}}{\left(\frac{1}{N_{env}}\right)\sum_i T_{env}(i)}, \tag{20}$$

where one frame of time domain signal is divided into many small segments; find the maximum magnitude among those small segments; calculate the average magnitude of those small segments; if the peak magnitude is very large relatively to the average magnitude, there is a good chance that the energy attack exists, which means it is a fast signal.

A variant expression of $P_2$ could be, $$P_2 = \frac{\mathrm{Max}\{T_{env}(i),\ i = 0, 1, \ldots\}}{\left(\frac{1}{N_{env}}\right)\sum_{i \neq peak\ area} T_{env}(i)} \tag{21}$$

where the peak energy area is excluded during the estimate of the average energy (or average magnitude).

Another variant is the ratio of the peak magnitude (energy) to the average frame magnitude (energy) before the energy peak point, $$P_2 = \frac{\text{Max}\{T_{env}(i),\ i = 0, 1, \ldots\}}{\left(\frac{1}{i_p}\right)\sum_{i<i_p} T_{env}(i)}, \tag{22}$$

find the maximum magnitude among those small segments and record the location of the peak energy; calculate the average magnitude of those small segments before the peak location; if the peak magnitude is very large relatively to the average magnitude before the peak location, there is a good chance that the energy attack exists.

Third variant parameter is the energy ratio between two adjacent small segments, $$P_2 = \text{Max}\left\{\frac{T_{env}(i+1)}{T_{env}(i)},\ i = 0, 1, 2, \ldots\right\}, \tag{23}$$

find the largest energy ratio of two adjacent small segments in the frame; if this ratio is very large, there is a good chance that the energy attack exists.

Pitch correlation or pitch gain; this parameter may be retrieved from CELP codec, estimated by calculating normalized pitch correlation with available pitch lag or evaluated from energy ratio between CELP adaptive codebook component and CELP fixed codebook component.

Normalized pitch correlation may be expressed as, $$R_p = \frac{\sum_n s(n)\cdot s(n-\text{Pitch})}{\sqrt{\sum_n [s(n)]^2}\cdot\sqrt{\sum_n [s(n-Picth)]^2}}, \tag{24}$$

This parameter measures the periodicity of the signal; normally, energy attack signal or unvoiced speech signal does not have high periodicity. A variant of this parameter can be, $$R_p = \frac{E_p}{(E_p + E_c)}, \tag{25}$$

Ep and Ec have been defined in the pre-art section; Ep represents the energy of CELP adaptive codebook component; Ec indicates the energy of fixed codebook components.

Spectral envelope variation; this parameter can be measured on spectral envelope by evaluating relative differences in each subband between current spectral envelope and previous spectral envelope. One example of the expression can be, $$\text{Diff_F}_{env} = \sum_i \frac{|F_{env}(i) - F_{env,old}(i)|}{F_{env}(i) + F_{env,old}(i)}, \tag{26}$$

Fenc(i) represents current spectral envelope, which could be in Log domain, Linear domain, quantized, unquantized, or even quantized index; Fenc,old(i) is the previous Fenc(i).

Variant measures could be like, $$\text{Diff_F}_{env} = \sum_i \frac{[F_{env}(i) - F_{env,old}(i)]^2}{[F_{env}(i) + F_{env,old}(i)]^2}, \tag{27}$$

$$\text{Diff_F}_{env} = \frac{\sum_i |F_{env}(i) - F_{env,old}(i)|}{\sum_i F_{env}(i) + F_{env,old}(i)}, \tag{28}$$

or, $$\text{Diff_F}_{env} = \frac{\sum_i [F_{env}(i) - F_{env,old}(i)]^2}{\sum_i [F_{env}(i) + F_{env,old}(i)]^2}, \tag{29}$$

Obviously, when Diff_Fenv is small, it is slow signal; otherwise, it is fast signal.

All above parameters can be performed in a form called running mean which takes some kind of moving average of recent parameter values; they can also play roles by counting the number of the small parameter values or large parameter values.

Very detailed ways of using the above mentioned parameters to do the classification of fast and slow signals could have lots of possibilities. Here given few examples. In these examples, fast signal includes speech signal and some fast changing music signal such as castanet signal; slow signal contains most music signals. The first example assumes that ITU-T G.729.1 is the core of a scalable super-wideband extension codec; the available parameters are Rp which represents the signal periodicity defined in (25), Sharp which represents the spectral sharpness defined in (19), Peakness which represents the temporal sharpness defined in (20), and Diff_Fenv represents the spectral variation defined in (26). Here is the example logic to do the classification for each frame while using the memory values from previous frames:

```
    /* Initial for first frame */
    if (first frame is true)   {
        Classification_flag=0;      /*   0:   fast signal,   1 : slow
        signal   */
        Pgain_sm=0;
        Sharp_sm=0;
    Peakness_sm=0;
        Cnt_Diff_fEnv=0;
    Cnt2_Diff_fEnv=0;
}
/* preparation of parameters */
Pgain_sm = 0.9*Pgain_sm + 0.1*Rp;            /* running mean */
Sharp_sm = 0.9* Sharp_sm + 0.1*Sharp;       /* running mean */
Peakness_sm = 0.9* Peakness_sm + 0.1*Peakness;   /* running mean */
    If   (Diff_fEnv<1.5f)   Cnt_Diff_fEnv = Cnt_Diff_fEnv + 1;
    else Cnt_Diff_fEnv =0;
    if   (Diff_fEnv<0.8f)   Cnt2_Diff_fEnv = Cnt2_Diff_fEnv + 1;
    else Cnt2_Diff_fEnv =0;
/*decision*/
    if (Classification_flag == 1)   {
        if (Peakness_sm>C1 and   Pgain_sm<0.6   and Sharp_sm<C2)
                Classification_flag =0;
        if (Diff_fEnv>2.3)
                Classification_flag =0;
    }
    else if (Classification_flag ==0)   {
        if (Peakness_sm <C1   and   Pgain_sm >0.6f   and
        Sharp_sm >C2)
                Classification_flag = 1;
```

-continued

```
        If (Cnt_Diff_fEnv >100)
                Classification_flag = 1;
    }
    else {
        Classification_flag is not changed here;
    }
  if (Cnt2_Diff_fEnv >2   and   Peakness_sm<C1 && Rp<0.6)
        Classification_flag = 1;
```

In the above program, C1 and C2 are constants tuned according to real applications. Classification_flag can be used to switch different BWE algorithms as described already; for example, for fast signal, the BWE algorithm keeps the synchronization between low band signal and high band signal; for slow signal, the BWE algorithm should focus the spectral quality or frequency resolution.

The following gives the second example which is used to decide if a frequency domain post-processing is necessary. For example, in ITU-T G.729.1, the low band signal is mainly coded with CELP algorithm which works well for fast signal; but the CELP algorithm is not good enough for slow signal, for which additional frequency domain post-processing may be needed. Suppose the available parameters are Rp which represents the signal periodicity defined in (25), Sharpness=1/P1 and P1 is defined in (19), and Diff_Fenv represents the spectral variation defined in (26). Here is the example logic to do the classification for each frame while using the memory values from previous frames:

```
/* Initial for first frame */
if (first frame is true) {
            Classification_flag=0;      /*   0:   fast signal,   1 : slow
            signal   */
  spec_count=0;
  sharp_count=0;
  flat_count=0;
}
/* First Step:   hard decision   of   Classification_flag */
     If   ( Diff_fEnv <0.4   and   Sharpness<0.18 )   {
            spec_count= spec_count+ 1;
     }
     else {
          spec_count = 0;
}
if (   (Diff_fEnv <0.7   and   Sharpness<0.13)   or
          (Diff_fEnv <0.9   and   Sharpness<0.06)   ) {
sharp_count = sharp_count + 1;
}
else {
            sharp_count = 0;
  }
  if (   (spec_count>32)   or   (sharp_count>64)   )   {
          Classification_flag= 1 ;
     }
       if ( Sharpness>0.2 and Diff_fEnv >0.2) {
flat_count = flat_count + 1;
   }
   else {
flat_count = 0;
  }
  if   (      (flat_count>3 and   Diff_fEnv >0.3)   or
              (flat_count>4   and   Diff_fEnv >0.5)   or
              (flat_count>100)   )   {
    Classification_flag=0;
}
```

The parameter Control is used to control a frequency domain post-processing; when Control=0, it means the frequency domain post-processing is not applied; when Control=1, the strongest frequency domain post-processing is applied. Since Control can be a value between 0 and 1, a soft control of the frequency domain post-processing can be performed in the following example way by using the proposed parameters:

```
/* Second Step:   soft decision   of   Control   */
      Initial :   Control = 0.6;
      Voicing = 0.75*Voicing + 0.25*Rp;          /* running mean */
    if (   Classification_flag==0 )   {
          Control = 0;
    }
    else {
          if (Sharpness>0.18 or   Voicing>0.8) {
                Control   =   Control * 0.4;
          }
          else if (Sharpness>0.17   or   Voicing>0.7)   {
              Control   =   Control * 0.5;
          }
           else if (Sharpness>0.16   or   Voicing>0.6)   {
                Control   =   Control * 0.65;
          }
          else if (Sharpness>0.15 or Voicing>0.5) {
                Control   =   Control * 0.8;
    }
}
  Control_sm = 0.75*Control_sm + 0.25*Control;    /* running mean */
```

Control_sm is the smoothed value of Control; if Control_sm is used instead of Control, the parameter fluctuation can be avoided.

The above description can be summarized as a method of classifying audio signal into fast signal and slow signal, based on at least one of the following parameters or a combination of the following parameters: spectral sharpness, temporal sharpness, pitch correlation (pitch gain), and/or spectral envelope variation. Fast signal shows its fast changing spectrum or fast changing energy; slow signal indicates both spectrum and energy of the signal change slowly. Speech signal and energy attack music signal can be classified as fast signal while most music signals are classified as slow signal. High band fast signal can be coded with BWE algorithm producing high time resolution, such as keeping temporal envelope coding and the synchronization with low band signal; high band slow signal can be coded with BWE algorithm producing high frequency resolution, for example, which does not keep temporal envelope coding and the synchronization with low band signal. Fast signal can be coded with time domain coding algorithm producing high time resolution, such as CELP coding algorithm; slow signal can be coded with frequency domain coding algorithm producing high frequency resolution, such as MDCT based coding. Fast signal can be post-processed with time domain post-processing approach, such as CELP post-processing approach; slow signal can be post-processed with frequency domain post-processing approach, such as MDCT based post-processing approach.

Figure 7:
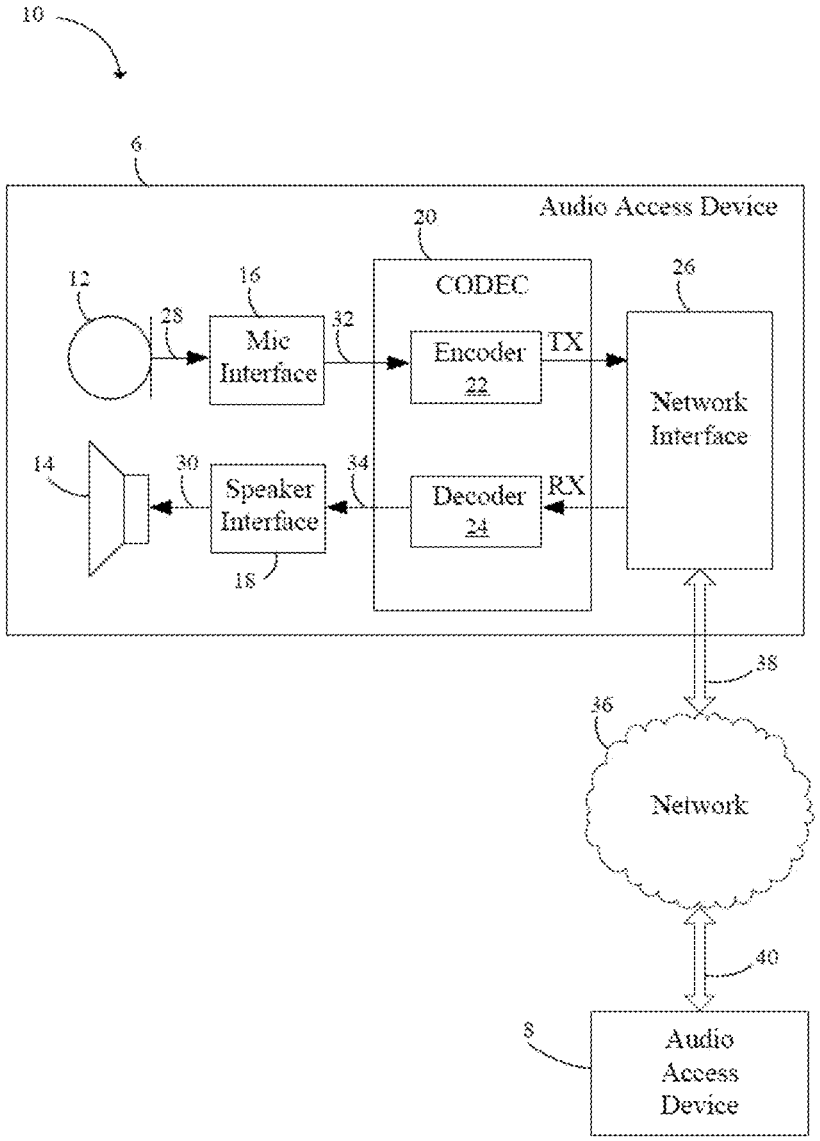
FIG. 7 illustrates communication system according to an embodiment of the present invention.

FIG. 7 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PTSN) and/or the internet. Communication links 38 and 40 are wire line and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In an embodiments of the present invention, where audio access device 6 is a VOIP device, some or all of the components within audio access device 6 are implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (AD) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The above description contains specific information pertaining to the classification of slow signal and fast signal. However, one skilled in the art will recognize that the present invention may be practiced in conjunction with various encoding/decoding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention which use the principles of the present invention are not specifically described in the present application and are not specifically illustrated by the present drawings.

What is claimed is:

1. A method of classifying an audio signal into a fast signal or a slow signal for audio coding, comprising:

determining, by an encoder comprising a processor, a parameter of each of the plurality of frames of the audio signal, wherein the audio signal has a plurality of frames, wherein each of the plurality of frames has at least two spectral sub-bands;

comparing, by the encoder, the parameter with a predefined threshold as one of determination elements to determine whether each of the plurality of frames should be classified into a fast frame or a slow frame;

processing, by the encoder, the fast frame in a fast mode to obtain a processed fast frame suitable for writing into a bitstream for storing or transmitting; or processing, by the encoder, the slow frame in a slow mode to obtain a processed slow frame suitable for writing into a bitstream for storing or transmitting;

wherein the parameter is determined according to spectral sharpness, Spec_Sharp, which is defined as follows:

$$\text{Spec_Sharp} = \frac{N_i \cdot \text{Max}\{|MDCT_i(k)|,\ k = 0, 1, 2, \ldots N_i - 1\}}{\sum_k |MDCT_i(k)|}$$

wherein $MDCT_i(k)$, $k=0,1, \ldots ,N_i-1$, are frequency coefficients in a i-th spectral sub-band of a frame of the audio signal, and $N_i$ is the number of spectral coefficients in the i-th spectral sub-band.

2. The method of claim 1, wherein the fast signal has a fast changing spectrum or a fast changing energy level, and the slow signal has a slow changing spectrum and a slow changing energy level.

3. The method of claim 1, wherein the fast signal is a speech signal or an energy attack music signal, and the slow signal is any music signal except the energy attack music signal.

4. The method of claim 1, wherein the fast signal is encoded using a Bandwidth Extension (BWE) algorithm for producing a high time resolution, and the slow signal is encoded using the BWE algorithm for producing a high frequency resolution.

5. The method of claim 1, wherein the fast signal is encoded using a Bandwidth Extension (BWE) algorithm having a temporal envelope shaping coding, and the slow signal is encoded using the BWE algorithm without having the temporal envelope shaping coding.

6. The method of claim 1, wherein the fast signal is post-processed using a time domain post-processing procedure and the slow signal is post-processed using a frequency domain post-processing procedure.

7. The method of claim 1, wherein the fast signal is encoded using a time domain algorithm and-the slow signal is encoded using a frequency domain algorithm.

8. The method of claim 7, wherein the time domain algorithm is a Code-Excited Linear Prediction (CELP) algorithm, and the frequency domain algorithm is a Modified Discrete Cosine Transform (MDCT) based algorithm.

9. A method of classifying an audio signal into a fast signal or a slow signal for audio coding, the method comprising:

determining, by an encoder comprising a processor, a parameter of each of the plurality of frames of the audio signal, wherein the audio signal has a plurality of frames; and comparing, by the encoder, the parameter with a predefined threshold as one of determination elements to determine whether each of the plurality of frames should be classified into the fast signal or the slow signal, processing, by the encoder, the fast signal in a fast signal mode to obtain a processed fast signal suitable for writing into a bitstream for storing or transmitting; or processing, by the encoder, the slow signal in a slow signal mode to obtain a processed slow signal suitable for writing into a bitstream for storing or transmitting;

wherein the parameter is or is a function of temporal sharpness which is defined as a ratio between a maximum temporal magnitude and an average temporal magnitude on a temporal sub-frame or a temporal frame;

wherein the parameter is or is a function of temporal sharpness, and the temporal sharpness, Temp_Sharp, is defined by a ratio between a peak magnitude at an energy peak point and an average magnitude before the energy peak point in the time domain, $$\text{Temp_Sharp} = \frac{T_{env}(i_p)}{\left(\frac{1}{i_p}\right)\sum_{i<i_p} T_{env}(i)}$$

$$T_{env}(i_p) = \text{Max}\{T_{env}(i),\ i = 0, 1, \ldots\}$$

where $\{T_{env}(i), i=0,1, \ldots\}$ is a temporal energy envelope, $T_{env}(i_p)$ is the peak magnitude at the energy peak point $i_p$, and Temp_Sharp is the temporal sharpness expressed in a Linear domain or a Log domain.

10. The method of claim 9, wherein the fast signal has a fast changing spectrum or a fast changing energy level, and the slow signal has a slow changing spectrum and a slow changing energy level.

11. The method of claim 9, wherein the fast signal is a speech signal or an energy attack music signal, and the slow signal is any music signal except the energy attack music signal.

12. The method of claim 9, wherein the fast signal is encoded using a Bandwidth Extension (BWE) algorithm for producing a high time resolution, and the slow signal is encoded using the BWE algorithm for producing a high frequency resolution.

13. The method of claim 9, wherein the fast signal is encoded using a Bandwidth Extension (BWE) algorithm having a temporal envelope shaping coding, and the slow signal is encoded using the BWE algorithm without having the temporal envelope shaping coding.

14. The method of claim 9, wherein the fast signal is post-processed using a time domain post-processing procedure and the slow signal is post-processed using a frequency domain post-processing procedure.

15. The method of claim 9, wherein the fast signal is encoded using a time domain algorithm and the slow signal is encoded using a frequency domain algorithm.

16. The method of claim 15 wherein the time domain algorithm is a Code-Excited Linear Prediction (CELP) algorithm, and the frequency domain algorithm is a Modified Discrete Cosine Transform (MDCT) based algorithm.

17. An encoder of classifying an audio signal into a fast signal or a slow signal for audio coding, comprising:

a memory for storing processor-executable instructions; and a processor operatively coupled to the memory, the processor being configured to execute the processor-executable instructions to facilitate the following steps:

determining, by an encoder comprising a processor, a parameter of each of the plurality of frames of the audio signal, wherein the audio signal has a plurality of frames, wherein each of the plurality of frames has at least two spectral sub-bands;

comparing, by the encoder, the parameter with a predefined threshold as one of determination elements to determine whether each of the plurality of frames should be classified into a fast frame or a slow frame;

processing, by the encoder, the fast frame in a the fast mode to obtain a processed fast frame suitable for writing into a bitstream for storing or transmitting; or processing, by the encoder, the slow frame in a slow mode to obtain a processed slow frame suitable for writing into a bitstream for storing or transmitting;

wherein the parameter is determined according to spectral sharpness, Spec_Sharp, which is defined as follows:

$$\text{Spec_Sharp} = \frac{N_i \cdot \text{Max}\{|MDCT_i(k)|,\ k = 0, 1, 2, \ldots N_i - 1\}}{\sum_k |MDCT_i(k)|}$$

wherein $MDCT_i(k)$, $k=0,1, \ldots, N_i-1$, are frequency coefficients in a i-th spectral sub-band of a frame of the audio signal, and $N_i$ is the number of spectral coefficients in the i-th spectral sub-band.

* * * * *